US009657525B2

(12) United States Patent
Ray et al.

(10) Patent No.: US 9,657,525 B2
(45) Date of Patent: May 23, 2017

(54) SUBSEA WELLHEAD ASSEMBLY, A SUBSEA INSTALLATION USING SAID WELLHEAD ASSEMBLY, AND A METHOD FOR COMPLETING A WELLHEAD ASSEMBLY

(75) Inventors: Anthony Ray, Pau (FR); Patrick Marcellin, Buros (FR); Gilles Leger, St. Faust (FR)

(73) Assignee: TOTAL SA, Courbevoie (FR)

( * ) Notice: Subject to any disclaimer, the term of this patent is extended or adjusted under 35 U.S.C. 154(b) by 0 days.

(21) Appl. No.: 14/240,176

(22) PCT Filed: Aug. 23, 2011

(86) PCT No.: PCT/IB2011/002292

§ 371 (c)(1),
(2), (4) Date: Jun. 23, 2014

(87) PCT Pub. No.: WO2013/027081

PCT Pub. Date: Feb. 28, 2013

(65) Prior Publication Data

US 2014/0299328 A1 Oct. 9, 2014

(51) Int. Cl.

| | |
|---|---|
| ***E21B 7/12*** | (2006.01) |
| ***E21B 33/035*** | (2006.01) |
| ***E21B 33/043*** | (2006.01) |
| ***E21B 34/04*** | (2006.01) |

(52) U.S. Cl.

CPC ..... *E21B 7/12* (2013.01); *E21B 33/035* (2013.01); *E21B 33/043* (2013.01); *E21B 34/04* (2013.01)

(58) Field of Classification Search

CPC ..... E21B 33/043

USPC ..... 166/348, 368; 1/348, 368

See application file for complete search history.

(56) References Cited

U.S. PATENT DOCUMENTS

| | | | | |
|---|---|---|---|---|
| 5,195,589 | A * | 3/1993 | Mota | F16L 37/002 166/341 |
| 5,244,045 | A * | 9/1993 | Mota | E21B 43/013 166/341 |
| 5,971,077 | A | 10/1999 | Lilley | |
| 5,992,527 | A | 11/1999 | Garnham et al. | |
| 6,053,252 | A * | 4/2000 | Edwards | E21B 19/22 166/338 |
| 6,223,675 | B1 * | 5/2001 | Watt | B63G 8/001 114/312 |
| 6,345,668 | B1 | 2/2002 | Reilly | |
| 6,357,529 | B1 | 3/2002 | Kent et al. | |
| 6,742,594 | B2 * | 6/2004 | Langford | B01D 17/0211 166/343 |
| 6,966,383 | B2 * | 11/2005 | Milberger | E21B 33/043 166/368 |
| 7,108,069 | B2 * | 9/2006 | Killie | E21B 33/0355 166/336 |
| 7,121,346 | B2 * | 10/2006 | Wolff | E21B 33/035 166/348 |
| 7,143,830 | B2 * | 12/2006 | Bartlett | E21B 23/00 166/339 |

(Continued)

*Primary Examiner* — Matthew R Buck
*Assistant Examiner* — Aaron Lembo
(74) *Attorney, Agent, or Firm* — Patterson Thuente Pedersen, P.A.

(57) ABSTRACT

A subsea wellhead assembly comprising at least a casing housing and a casing extending down inside the well, and a tubing hanger. The tubing hanger comprises first and second valves, each valve being a fail safe valve.

4 Claims, 2 Drawing Sheets

(56) References Cited

U.S. PATENT DOCUMENTS

| | | | | |
|---|---|---|---|---|
| 7,219,740 | B2 * | 5/2007 | Saucier | E21B 33/035 166/344 |
| 7,296,629 | B2 * | 11/2007 | Bartlett | E21B 33/038 166/339 |
| 7,395,866 | B2 * | 7/2008 | Milberger | E21B 33/043 166/345 |
| 7,419,001 | B2 * | 9/2008 | Broussard | E21B 23/01 166/341 |
| 7,422,066 | B2 * | 9/2008 | Rodrigues | E21B 43/01 166/241.6 |
| 7,552,762 | B2 * | 6/2009 | Khazanovich | E21B 33/0385 166/379 |
| 7,565,931 | B2 * | 7/2009 | Saucier | E21B 33/035 166/344 |
| 7,707,076 | B1 * | 4/2010 | Whiteley | G06Q 10/06 340/10.1 |
| 8,074,722 | B2 * | 12/2011 | Murphy, Jr. | E21B 33/043 166/277 |
| 8,322,442 | B2 * | 12/2012 | Voss | E21B 43/121 166/311 |
| 8,425,154 | B1 * | 4/2013 | Lugo | F16L 1/26 166/347 |
| 8,449,221 | B1 * | 5/2013 | Lugo | F16L 1/26 405/169 |
| 8,636,447 | B1 * | 1/2014 | Lugo | F16L 1/26 405/158 |
| 8,672,038 | B2 * | 3/2014 | Tan | E21B 33/035 166/338 |
| 9,074,428 | B2 * | 7/2015 | Lavagna | E21B 17/012 |
| 9,080,411 | B1 * | 7/2015 | Lugo | E21B 33/064 |
| 2008/0093081 | A1 * | 4/2008 | Stoisits | E21B 43/017 166/366 |

* cited by examiner

SUBSEA WELLHEAD ASSEMBLY, A SUBSEA INSTALLATION USING SAID WELLHEAD ASSEMBLY, AND A METHOD FOR COMPLETING A WELLHEAD ASSEMBLY

PRIORITY CLAIM

The present application is a National Phase entry of PCT Application No. PCT/IB2011/002292, filed Aug. 23, 2011, said application being hereby incorporated by reference herein in its entirety.

FIELD OF THE INVENTION

The present invention concerns a subsea wellhead assembly, a subsea installation using said wellhead assembly, and a method for completing a wellhead assembly.

BACKGROUND OF THE INVENTION

For a subsea well bore, the well is provided with a wellhead placed on the seabed to ensure the sealing of the well and oil reservoir against its environment (the sea). Then, for hydrocarbon fluid production, a Christmas tree is usually fitted on the wellhead to control the flow of hydrocarbon fluid (for example, oil or gas).

Usually, a wellhead assembly is equipped at its upper end with a Christmas tree comprising a plurality of valves for securing the well and a control flow device for controlling the flow of hydrocarbon fluid pulled out from the well.

The document U.S. Pat. No. 5,992,527 discloses such a wellhead assembly having a tubing hanger adapted to suspend a tubing that extends inside the casing and inside the well. The wellhead is equipped with an in-line tree comprising valves and an horizontal tree aligned with a lateral bore of the in-line tree. The flow of hydrocarbon fluid is controlled by additional valves and equipments secured to the horizontal tree forming a huge and heavy conventional Christmas tree above the wellhead assembly.

Such wellhead equipped with a Christmas tree for controlling the hydrocarbon fluid flow, and for providing security fail safe valves are difficult to be assembled down to the seabed. Therefore, such completion extends during days, and is costly.

SUMMARY OF THE INVENTION

One object of the present invention is to provide a wellhead assembly placed at a top of a subsea well, said subsea wellhead assembly comprising:

- at least a casing housing secured to the seabed and a casing extending down inside the well,
- a tubing hanger having a lower end and an upper end, the lower end being adapted to suspend a tubing that extends down inside the casing and inside the well, a cylindrical space being in continuity inside the tubing and the tubing hanger for extracting an hydrocarbon fluid from the well, and wherein the tubing hanger comprises at least a first and a second valves located in series inside the cylindrical space, each valve of the first and second valves having an opened state and a closed state, and each valve being naturally in the closed state and needing to be operated to remain in the opened state.

Thanks to these features, the wellhead assembly is itself safe and can not leak any hydrocarbon fluid and the setting up of a Christmas tree above the wellhead assembly for securing and controlling the well can be avoided.

The wellhead assembly is simpler and less expensive.

In various embodiments of the wellhead assembly, one and/or other of the following features may optionally be incorporated:

- the assembly does not comprise a flow control device;
- the upper end of the tubing hanger is adapted to be directly and only connected to a jumper line for transferring the hydrocarbon fluid out of the wellhead assembly;
- the tubing hanger extends in a direction substantially perpendicular to the seabed, and the upper end of the tubing hanger is adapted to be connected to a jumper line in any angular position around said direction;
- the first and second valves are metal ball valves.

Another object of the invention is to provide a subsea installation, comprising:

- a wellhead assembly as defined above and fitted above a well,
- a manifold for transferring the hydrocarbon fluid to a storage system, and
- a jumper line connected to said well head and to said manifold for transferring the hydrocarbon fluid from the well to the manifold, and wherein said subsea installation comprises a flow control device that is integrated inside the manifold.

Thanks to these features, the subsea installation is more easily installed on the seabed. Time is saved, and the installation is less expensive.

In an embodiment of the wellhead assembly proposed by the invention, one and/or the other of the following features may optionally be incorporated:

- the flow control device is not integrated above the wellhead assembly;
- the jumper line comprises a well jumper connector at a first end of said jumper line, said well jumper connector having a weight lower than ten tonnes;
- the jumper line is a flexible line;
- the tubing hanger extends in a direction substantially perpendicular to the seabed, and the upper end of the tubing hanger is adapted to be connected to a jumper line in any angular position around said direction.

Another object of the invention is to provide a method for completing a wellhead assembly as defined above, said method comprising the following successive steps:

- drilling a first section of the well,
- installing a housing inside said section and securing said housing to the seabed,
- installing a blow out preventer device above the housing,
- drilling the well down to a hydrocarbon fluid reservoir,
- running a tubing and a tubing hanger through the blow out preventer device and into the housing,
- removing the blow out preventer device, and
- connecting a first end of a jumper line to the wellhead assembly at one end of said jumper line and to an upper end of the wellhead assembly.

BRIEF DESCRIPTION OF THE DRAWINGS

Other features and advantages of the invention will be apparent from the following detailed description of one of its embodiments given by way of non-limiting example, with reference to the accompanying drawings. In the drawings.

In the various figures, the same reference numbers indicate identical or similar elements.

DETAILED DESCRIPTION OF THE DRAWINGS

Figure 1:
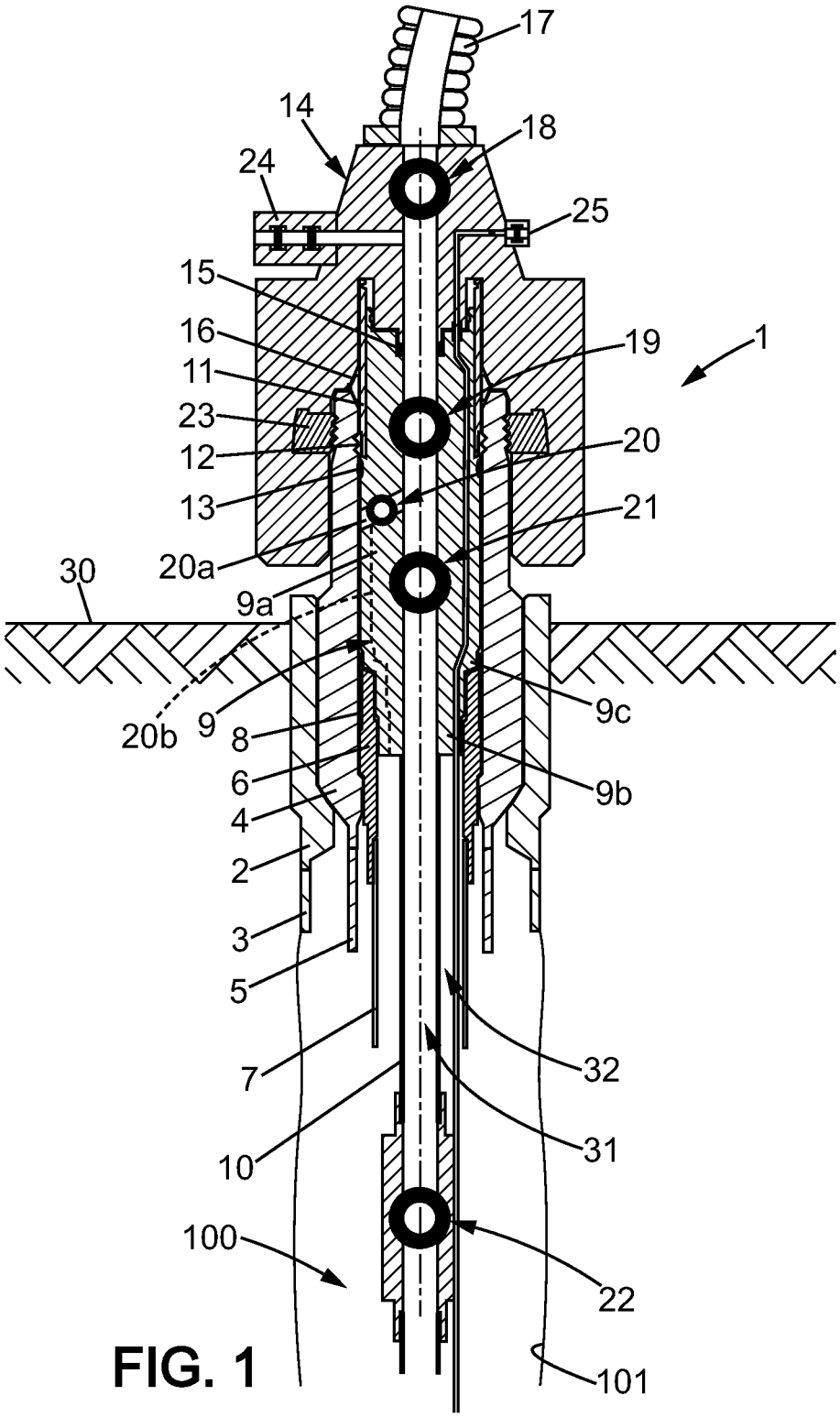
FIG. 1 is a vertical cross section of a subsea wellhead assembly according to the invention.

As shown in FIG. 1, a subsea wellhead assembly 1 is mainly composed of a plurality of concentric cylindrical housings secured at an upper end of a well 100 and corresponding casings (tubes) extending down into the hole 101 from said housings. The following embodiment description will firstly list the components of the wellhead from the outside to the inside.

Firstly, the wellhead comprises a first housing 2, and a first casing 3 extending down inside the well 100 from said first housing 2.

The first housing 2 is cemented to the seabed 30 for securing the wellhead to said seabed 30. After soak time period, the cementation is set on the seabed. Such first housing is called low pressure housing because it is structural, and acts as a ground anchor to the seabed 30.

The first casing 3 has a large diameter. It is for example a diameter of 30" or 36" (762 mm or 914 mm).

Secondly, the wellhead comprises a second housing 4, and a second casing 5 extending down inside the well from said second housing 4 and inside the first casing 3.

The second housing 4 is secured to the first housing. Such second housing is called a high pressure housing because is dimension to resist to the maximum expected reservoir pressure.

The second casing 5 has an intermediate diameter. It is for example a diameter of 20" (508 mm).

Thirdly, the wellhead comprises a third housing 6 and a third casing 7 extending down inside the well 100 from said third housing 6 and inside the second casing 5. The third housing 6 is usually named a casing hanger. And, the third casing 7 is usually simply named a casing.

The third housing 6 is secured to the second housing 4.

The third casing 7 has a small diameter. It is for example a diameter of 10¾" (273 mm).

Then, the wellhead comprises a tubing hanger 9 and a tubing 10 extending down inside the well 100 from said tubing hanger 9 and inside the casing 7, and down to the well bottom.

The tubing hanger 9 comprises an upper portion 9*a* having an external diameter corresponding substantially to the internal diameter of the second housing, a lower portion 9*b* corresponding substantially to the internal diameter of the third housing, and a shoulder 9*c* between said upper portion 9*a* and lower portion 9*b*, The tubing hanger 9 is then landed by its shoulder 9*c* above the third housing 6 (casing hanger), and secured and locked by its upper portion 9*a* to the second housing 4.

For example, a lock sleeve 11 is actuated downwards from an upper end of the tubing hanger to engage a lock ring 12 into a reciprocal groove managed inside the second housing 4.

The tubing 10 extends down from the lower portion 9*b* of the tubing hanger 9 and it has a diameter, for example, of 5½" (139 mm). A cylindrical space 31 is defined inside the tubing 10. An annular space 32 is defined between the tubing 10 and the casing 7.

The cylindrical space 31 extends from the tubing 10 through the lower portion 9*b* to the upper portion 9*a* of the tubing hanger 9.

A pack off assembly 8 comprises a first seal for sealing the third housing 6 (casing hanger) to the second housing 4. The fluid is prevented to leak from the annular space 32 to the surrounding annular spaces of the second and third casings 5, 7.

The shoulder 9*c* is landed on top of the third housing 6 to secure the third housing 6 to the second housing 4.

A second seal 13 is annular and is sealing the upper portion 9*a* of tubing hanger 9 with respect to the second housing 4. Fluid from the annular space 32 can not leak out of the well.

For hydrocarbon production the tubing 10 may comprise lateral holes at its lower end at the well bottom, so that the hydrocarbon fluid enters inside the cylindrical space 31 of the tubing 10, and flows up to the wellhead through said cylindrical space 31.

The tubing hanger 9 of the present invention further comprises a first valve 19 and a second valve 21. The first and second valves 19, 21 are situated in the tubing hanger 9 along the cylindrical space 31.

All the valves of the wellhead assembly have an opened state and a closed state. In the open state, fluid can flow through the valve. In the closed stated, fluid can not flow through the valve.

The first and second valves 19, 21 are fail safe: they are naturally (without external input) in the closed state, and they can be operated to switch and to remain in the opened state by means of an external input.

The first and second valves 19, 21 are therefore a double barrier against fluid leaking from the well, in case of emergency situation. The well is for example completely and automatically sealed when the production platform ordered an emergency shut down, or if all the connections between the production platform and the wellhead are lost.

These first and second valves, integrated inside the tubing hanger 9 replace the usual Christmas tree valves: the first valve 19 replaces the production wing valve, and the second valve 21 replaces the production master valve.

The first and second valves 19, 21 can be identical or not. They may be metal to metal sealing ball valves.

A lateral channel 20*a* is linking the cylindrical space 31 to the external diameter of the tubing hanger 9, said lateral channel being below the second seal 13. This portion of the external diameter of the tubing hanger 9 is in communication with the annular space 32 of the well. The lateral channel 20*a* is a small channel. The lateral channel 20*a* has a diameter of 1½" (38 mm), and is in communication with the annular space 32 by a peripheral channel 20*b* of ½" (13 mm) which is one of the cylinder generatrix.

The lateral channel 20*a* further comprises a third valve 20 also named the cross over valve.

The third valve 20 replaces the known cross over valve found in a Christmas tree. Thanks to this third valve a fluid over pressure in the annular space 32 can be vented off into the cylindrical space 31, and can therefore be cancelled.

The third valve 20 can be a ball valve, a gate valve or a sliding sleeve valve.

The third valve 20 is also fail safe: it is naturally (without external input) in the closed state, and it can be operated to switch and to remain in the opened state by means of an external input.

Thanks to this features, the wellhead is not equipped with a conventional Christmas tree that usually fits on top of the housings during hydrocarbon fluid production.

The Christmas tree usually fits on top of the housings, extends above the seabed 30. The Christmas tree comprises the above defined first second and third valves, and comprises other valves and equipments for controlling the flow of hydrocarbon fluid out of the well. Typically a subsea tree would have a choke (permits control of flow), a flowline connection interface, subsea control interface (hydraulic, electro hydraulic, or electric) and sensors for measuring data such as pressure, temperature, sand flow, erosion, multiphase flow, single phase flow.

A subsea Christmas tree is therefore a complex device having a big size above the seabed 30.

The present invention incorporates the Christmas tree valves inside the tubing hanger 9. The other functionalities (control and sensors) are incorporated inside a manifold 40 landed on the seabed near the well.

Incorporating two fail safe valves 19, 21 inside the tubing hanger 9 is quite difficult because of the sizes of these elements.

However, this provides many advantages. The first and second valves are incorporated inside the first element connected to the tubing 10. These valves can not be disassembled from the tubing hanger 9. They are also at lower distance above from the seabed. Eventually, these valves are above the seabed 30. Consequently, the first and second valves 19, 21 are more securely attached to the wellhead. They risk of Christmas tree disconnection from the wellhead is avoided. The well is closed more securely.

Figure 2:
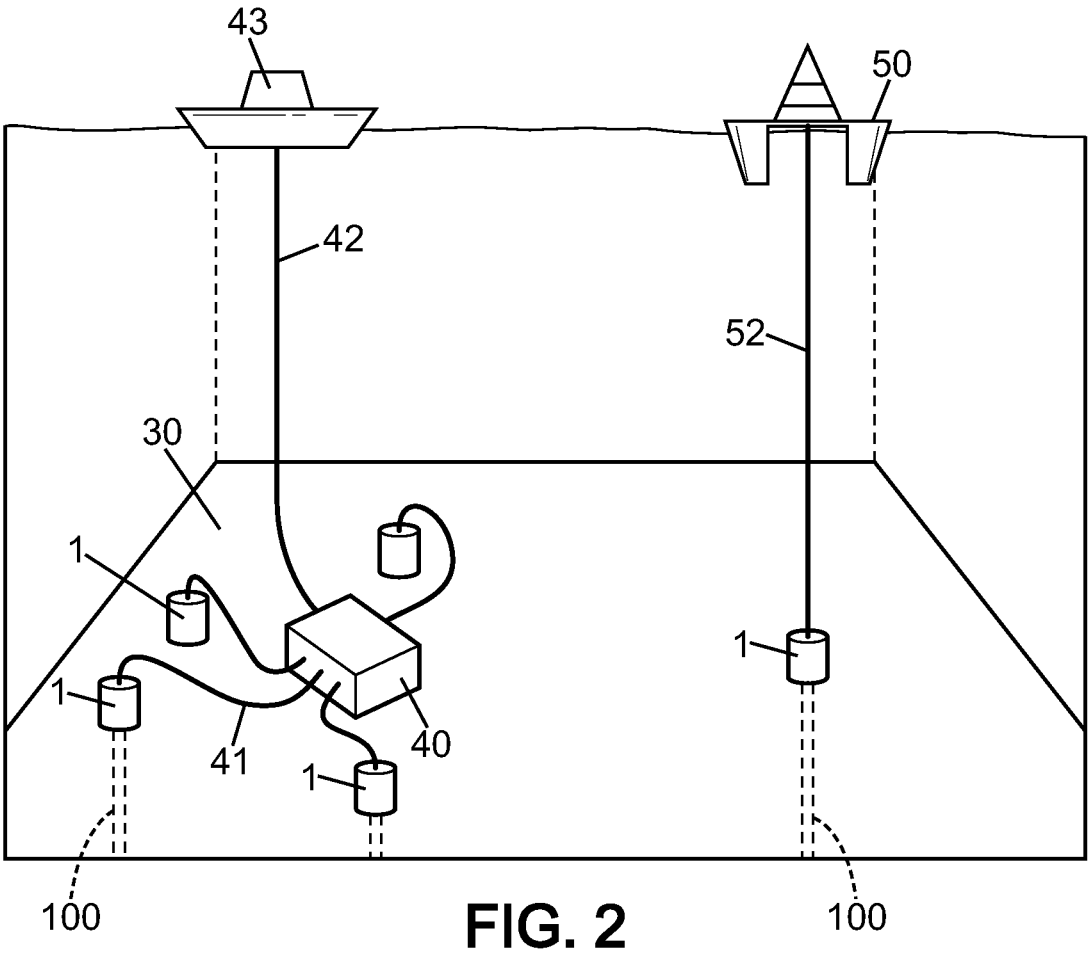
FIG. 2 is a subsea installation comprising a plurality of wellhead assembly of FIG. 1.

An overview of a subsea installation is illustrated on FIG. 2. A plurality of wellhead assembly 1 is connected to a single manifold 40 on the seabed 30.

The subsea installation at least comprises a plurality of wellhead assembly 1 without any Christmas tree, and a manifold 40 for transferring the hydrocarbon fluid via a flow line 42 to a storage system 43, said storage system 43 being for example a production and storage vessel floating on the sea surface.

Each wellhead assembly 1 is therefore directly and only connected to the manifold 40 via a jumper line 41 for transferring the hydrocarbon fluid from each wellhead assembly 1 to the manifold 40.

The manifold 40 further comprises for each jumper line 41 a flow control device. The flow control devices are not integrated above the wellhead assemblies 1 and are all integrated inside the manifold 40. The wellhead assembly 1 is simpler.

The jumper line 41 is preferably a flexible line 17, so that the installation is more easily installed on the seabed 30, with less mechanical constraints. It comprises a bend restricted exterior carcass to maintain a radius value that is higher to predetermined value. The jumper line 41 can be oriented from the wellhead 1 to a direction where the manifold 40 is.

The jumper line 41 comprises a first end adapted to be connected to the wellhead assembly 1 and a second end adapted to be connected to the manifold 40.

The first end of the jumper line 41 comprises a well jumper connector 14 that is locked to the second housing 4 (high pressure) by locking means 23, like an actuated ring. The well jumper connector 14 is also sealed to the wellhead assembly via a third seal 15 and a fourth seal 16. These seals are metal to metal seals.

The well jumper connector 14 is vertically assembled and locked to the wellhead assembly 1, for example via a remote operated vehicle (ROV). Such process is simpler than with a conventional Christmas tree as it is completely vertical.

The upper end of the tubing hanger (9) and the jumper connector (14) of the jumper line (41) are adapted to be connected to each other in any angular position around a direction corresponding to the main direction of the tubing hanger (9). Said direction is usually substantially perpendicular to the seabed. The well jumper connector 14 does not need to be angularly oriented, and the connection of the jumper lines (41) to the wellhead assemblies are facilitated, and lost of time is saved.

With a conventional vertical Christmas tree system, a guide base fitted to the wellhead is needed to help in aligning the Christmas tree to the tubing hanger. The conventional Christmas tree generally weighs between 30 and 50 tonnes.

According to present invention, the guide base is not needed, as the well jumper connector weight much smaller than the conventional Christmas tree. For example, the well jumper connector 14 weights between 5 and 10 tonnes, as it has a smaller dimensional envelope. The manipulation of the components of the wellhead assembly and installation is facilitated.

Additionally, the well jumper connector 14 is able to be orientated by the ROV, without any additional equipment for orientation. Because of the conventional Christmas trees requirement for a guide base, it is also necessary to use a blow out preventer (BOP) pin system to correctly orientate the tubing hanger in the wellhead, before the Christmas tree is landed.

According to present invention, the well jumper connector 14 can be orientated relative to the wellhead 1 only by a ROV for controlling the jumper line 41 alignment between the well jumper connector 14 and the tubing hanger 9. Such alignment requirement of the invention is a much easier than for a conventional Christmas tree alignment requirement: the need for equipment is lower. The spent time for rig preparation and the time spent for operation are also lower.

The well jumper connector 14 may further comprise a fourth valve 18 that is able to retain the hydrocarbon fluid inside the jumper line 41, when said jumper line 41 is disconnected from the wellhead assembly 1. This valve is remotely operated and prevents hydrocarbon fluid loss from the jumper line inner content into the environment (sea).

The well jumper connector 14 may further comprise a fluid injection system that comprises two gate valves 24 to flush methanol inside the jumper line 41 before a disconnection of said jumper line 41 from the wellhead assembly 1.

Before disconnection of said jumper line 41 from the wellhead assembly 1, the first and second valves 19, 21 are closed; the flushing fluid (normally methanol) is injected through the fluid injection system 24 from the production facility 43, to evacuate all hydrocarbons above the first valve 19 and inside the jumper line 41 from a first end near the jumper connector 14 back to a second end near the manifold 40.

One of the well 100 on FIG. 2 is during drilling phase. A drilling system 50 is providing a drill string 52 of pipes, said drill string having a boring tool at the lower end to bore the well 100. The drilling system 50 may be a drilling platform floating on the sea surface. The drill string 52 is going down from the drilling system 50 and through the wellhead assembly 1 to bore the well.

The method for completing the well 100 with the wellhead assembly 1 of present invention is now explained.

A downward section of the well 100 is drilled.

The first casing 3 and the first housing 2 are ran inside the well section and cemented in place for seabed 30 securing.

A new section of the well 100 is drilled at a smaller diameter.

The second casing 5 and the second housing 4 are ran inside the first housing 2, and secured to it.

A blow out preventer device is ran above the second housing 4 and locked onto it.

The well 100 is then drilled down to the hydrocarbon fluid reservoir.

The third casing 7 and the third housing 6 are ran through the blow out preventer device, and secured to the second housing 4 thanks to the pack off assembly 8.

The tubing 10 and the tubing hanger 9 are ran and landed above the third housing 6, inside the second housing 4. Then, the tubing hanger 9 is locked thanks to the lock sleeve 11.

The tubing hanger 9 first and second valves 19, 21 are then tested by a hydraulic running tool.

The blow out preventer device is removed, said first and second valves 19, 21 being in the closed state.

A jumper line 41 coming from a manifold 40 is connected to the wellhead assembly 1, and the well 100 is then ready for hydrocarbon fluid production.

Usual method for completing a well that is equipped with a Christmas tree is more complex.

With conventional vertical Christmas tree installation, the blow out preventer is pulled after a drilling phase and a tubing hanger installation. The blow out preventer is pulled back onboard the drilling rig 50, and then the Christmas tree and its required running equipment is prepared and is ran to the wellhead 1 from the drilling rig 50. Upon completion of the Christmas tree installation, the flow line tie-in can be performed from the Christmas tree to the manifold.

With conventional horizontal Christmas tree installation, the blow out preventer is pulled twice. It is pulled after a first phase for drilling. The blow out preventer is pulled back onboard the drilling rig 50. Then, the horizontal Christmas tree and its required running equipment are prepared and are run to the wellhead from the drilling rig 50. Then, the blow out preventer device is ran again to the wellhead 1, and the tubing hanger is ran. Once the tubing hanger has been ran, the blow out preventer is pulled back onboard the drilling rig 50. The Christmas tree to manifold tie-in can be performed either after the Christmas tree is installed, or after the tubing hanger installation.

According to the present invention, the blow out preventer (BOP) is pulled only once, as with the conventional vertical Christmas tree. However, once it is pulled, the flow line tie-in can be performed to the manifold.

Thanks to the new wellhead assembly 1, such new method for completing the well saves at least between 3 to 4 days, depending on water depth. Thanks to these arrangements, the new method for completing the well saves time and is less expensive.

The embodiments above are intended to be illustrative and not limiting. Additional embodiments may be within the claims. Although the present invention has been described with reference to particular embodiments, workers skilled in the art will recognize that changes may be made in form and detail without departing from the spirit and scope of the invention.

Various modifications to the invention may be apparent to one of skill in the art upon reading this disclosure. For example, persons of ordinary skill in the relevant art will recognize that the various features described for the different embodiments of the invention can be suitably combined, un-combined, and re-combined with other features, alone, or in different combinations, within the spirit of the invention. Likewise, the various features described above should all be regarded as example embodiments, rather than limitations to the scope or spirit of the invention. Therefore, the above is not contemplated to limit the scope of the present invention.

The invention claimed is:

1. A subsea installation comprising at least:

a wellhead assembly placed at a top of a subsea well, the wellhead assembly not comprising a flow control device, said subsea wellhead assembly comprising:

a casing housing secured to the seabed and a casing extending down inside the well;

a tubing hanger having a lower end and an upper end, the lower end being adapted to suspend a tubing that extends down inside the casing and inside the well, a cylindrical space being in continuity inside the tubing and the tubing hanger for extracting an hydrocarbon fluid from the well;

and the tubing hanger comprising at least a first and a second valves located in series inside the cylindrical space, each valve of the first and second valves are fail safe valves having an opened state and a closed state, and each valve being naturally in the closed state and needing to be operated to remain in the opened state;

a manifold comprising a flow control device for transferring the hydrocarbon fluid to a storage system, and a jumper line connected to said wellhead assembly and to said manifold, said jumper line comprising at a first end a well jumper connector adapted to be locked to the casing housing, said well jumper connector having a weight lower than ten tonnes, wherein the upper end of the tubing hanger is adapted to be directly and only connected vertically to the well jumper connector of the jumper line.

2. The subsea installation according to claim 1, wherein jumper line is a flexible line.

3. The subsea installation according to claim 1, wherein the tubing hanger extends in a direction substantially perpendicular to the seabed, and the upper end of the tubing hanger is adapted to be connected to the jumper line in any angular position around said direction.

4. The subsea installation according to claim 1, wherein the first and second valves are metal ball valves.

* * * * *